US006931855B2

(12) United States Patent
Glessner et al.

(10) Patent No.: US 6,931,855 B2
(45) Date of Patent: Aug. 23, 2005

(54) ATTACHMENT SYSTEM FOR COUPLING COMBUSTOR LINERS TO A CARRIER OF A TURBINE COMBUSTOR

(75) Inventors: John Glessner, Oviedo, FL (US); Anil Gulati, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 209 days.

(21) Appl. No.: 10/436,319

(22) Filed: May 12, 2003

(65) Prior Publication Data

US 2004/0255597 A1 Dec. 23, 2004

(51) Int. Cl.[7] ..... F02C 7/20

(52) U.S. Cl. ..... 60/772; 60/798; 60/752; 29/890.01

(58) Field of Search ..... 60/752, 798, 772; 29/890.01

(56) References Cited

U.S. PATENT DOCUMENTS

| | | | | |
|---|---|---|---|---|
| 3,500,639 A | | 3/1970 | Stamm | |
| 4,180,972 A | | 1/1980 | Herman et al. | |
| 4,555,901 A | | 12/1985 | Wakeman et al. | |
| 4,567,730 A | | 2/1986 | Scott | |
| 4,614,082 A | | 9/1986 | Sterman et al. | |
| 4,912,922 A | | 4/1990 | Maclin | |
| 4,944,151 A | * | 7/1990 | Hovnanian | 60/800 |
| 5,291,732 A | | 3/1994 | Halila | |
| 5,323,601 A | | 6/1994 | Jarrell et al. | |
| 5,435,139 A | * | 7/1995 | Pidcock et al. | 60/757 |
| 5,596,870 A | * | 1/1997 | Dillard et al. | 60/782 |
| 5,701,733 A | | 12/1997 | Lewis et al. | |
| 5,758,503 A | * | 6/1998 | DuBell et al. | 60/752 |
| 6,279,313 B1 | | 8/2001 | Lawen, Jr. et al. | |
| 6,453,675 B1 | | 9/2002 | Royle | |
| 6,701,714 B2 | * | 3/2004 | Burd et al. | 60/752 |
| 2001/0035003 A1 | | 11/2001 | Sinha et al. | |
| 2003/0000223 A1 | | 1/2003 | Conete et al. | |
| 2003/0010038 A1 | * | 1/2003 | Maghon | 60/796 |

FOREIGN PATENT DOCUMENTS

| | | |
|---|---|---|
| CA | 1114623 | 12/1981 |
| GB | 1578474 | 11/1980 |

* cited by examiner

*Primary Examiner*—Ehud Gartenberg

(57) ABSTRACT

A system for attaching liners to a carrier for forming inner surfaces of turbine combustor. The system may include one or more liners attached to a carrier using connectors engaged to the carrier on a cold side of the liner and may include one or more liners attached to the carrier using connectors engaged to a hot side of the liners. The carrier may include one or more access ports for accessing from the hot side connectors engaged to the carrier on the cold side. In at least one embodiment, the system may include attaching all liners, except for one liner, to a carrier using connectors coupled to the carrier on the cold side and may include attaching the one liner to the carrier using connectors coupled to the carrier on the hot side.

18 Claims, 4 Drawing Sheets

ATTACHMENT SYSTEM FOR COUPLING COMBUSTOR LINERS TO A CARRIER OF A TURBINE COMBUSTOR

FIELD OF THE INVENTION

This invention is directed generally to turbine engines, and more particularly to attachment systems for coupling liners to a carrier of a turbine engine combustor.

BACKGROUND

Gas turbine combustors generally may be formed from annular combustors or can combustors. Annular combustors include a combustor chamber that is formed from a plurality of removable liners. The removable liners are exposed to extreme heat during operation, which often causes distortions and failure in liners. Thus, the liners are replaced at regular intervals to prevent such failure from occurring during operation.

The liners are often removably coupled to a carrier, which forms the support structure of the combustor, using either spring clips or bolted configurations. Spring clips couple liners to each other and to the carrier of a combustor. However, spring clips often suffer from relaxation and creep after being exposed to high temperatures commonly found in a combustor chamber, which can result in loss of clamp force in the clips. As a result, spring clips and liners can be liberated during operation of a combustor and cause substantial damage to a turbine engine. To prevent damage, spring clips often must be replaced frequently.

Combustor liners may be coupled to a carrier using either a hot side bolted method or a cold side bolted method. The hot side bolted method involves bolting liners to a carrier by inserting bolts through orifices in the liners from the hot side of the combustor, that is, the inner aspects of the combustor where combustion occurs. Liners installed in this manner may be removed by personnel entering the inner aspects of the combustor through a manhole or other device and loosing the bolts attaching the liners to a carrier. While liners attached to a carrier in this manner may be removed easily, this method of attachment has disadvantages and risks. For instance, should the bolts loosen during operation, the bolts pose a threat of becoming disengaged from the carrier and traveling downstream into turbine blade assemblies. In addition, the bolts are exposed to hot gases in the combustor chamber and consequently must be cooled and made from expensive alloys. Air supplied from the compressor of the turbine combustor is often used to cool the bolts; however, use of compressor supplied air increases nitrous oxide emissions and degrades turbine combustor performance.

The cold side bolted method involves using bolts installed from the cold side of the combustor, that is, the outside surface of the combustor. The bolts are passed through the carrier and are received by the liners. Installing bolts in this method alleviates the possibility of bolts loosening and traveling downstream and alleviates the need to cool the bolts. If a cold side coupled bolt were to loosen and become detached from the liner, the bolt would fall outside of the combustion cavity and, therefore, pose no threat of harm to the turbine assemblies. However, a significant disadvantage of the cold side bolted method is the amount of time needed to access the bolts to remove and replace the liners. The bolts may not be accessed from the inner aspects of the turbine combustor. Instead, the bolts typically may only be accessed after an engine casing has been lifted, which may take hours or weeks.

Thus, a need exists for a more efficient system and method for releasably attaching combustor liners to carriers.

SUMMARY OF THE INVENTION

This invention relates to a system for attaching liners to a carrier for creating an inner surface of a combustor of a turbine engine. The combustor may be, but is not limited to, an annular combustor. The system utilizes both hot side and cold side connectors while substantially eliminating the amount of time typically associated with removing cold side connectors. An exemplary annular combustor may be formed from at least two carriers, which may be an inner carrier and an outer carrier. The inner and outer carriers may form a combustor cavity having a generally toroidal shape. Inner liners may be attached to the inner carrier to form an inner liner surface, and outer liners may be attached to the outer carrier to form an outer liner surface. The inner carrier and its associated inner liners may be configured to fit inside a cavity defined by the outer liner surface formed by the outer liners to complete an annular combustor cavity.

The inner and the outer carriers may each have one or more liner receiving locations to which the liners may be attached. For clarity and brevity, the invention will be described with respect to inner carrier; however, the following description applies equally to the outer carrier. The inner carrier may have one or more access ports providing one or more openings through the inner carrier. In at least one embodiment, the inner carrier may include a plurality of access ports. Access panels may also be provided for closing the access ports. A single access port may be covered by a single liner or collectively covered by multiple liners.

The inner liners may be coupled to the inner carrier using one or more connectors, which may include, but are not limited to, threaded bolts. One or more inner liners may be coupled to the inner carrier using one or more connectors capable of being actuated, for example, using at least one tool engaging the connector, outside the combustor cavity. The outside portions of the combustor cavity may be referred to as the cold side of the annular combustor. Thus, one or more inner liners may be coupled to the inner carrier using one or more connectors on the cold side of the annular combustor.

One or more of the inner liners may also be coupled to the inner carrier using one or more connectors capable of being actuated, for example, using at least one tool engaging the connector, inside the combustor cavity. The inside portions of the combustor cavity may be referred to as the hot side of the combustor. Thus, one or more connectors may be used to attach one or more liners to the inner carrier using connectors on the hot side of the carrier.

In at least one embodiment, preferably all inner liners, except for one liner, may be coupled to the inner carrier using connectors actuated on the cold side of the carrier. When access ports are provided, the cold side actuating can be performed by accessing the cold side connectors through the access ports from the combustor cavity, that is, the hot side. The remaining one inner liner may be coupled to the inner carrier using one or more connectors actuated on the hot side of the carrier.

By coupling the inner liners to the inner carrier in this manner, the number of connectors susceptible to loosening and passing downstream into a turbine blade assembly are substantially reduced. In addition, by coupling the inner liners to the carrier in this manner, the inner liners may be removed and replaced from within the combustor cavity.

Thus, removal of the inner liners coupled to the inner carrier using connectors actuated on the cold side of the combustor does not necessitate removal of an engine casing and other related engine components shrouding the cold side to decouple the connectors. Rather, the cold side connectors may be tightened or loosened, or both, by accessing the connectors from the hot side through one or more access ports in the inner carrier.

In at least one method having features according to the invention, inner liners may be coupled to the inner carrier by first coupling the inner liners to the carrier using connectors actuated on the cold side of the annular combustor. The inner liners may be attached to the inner carrier by placing a first inner liner proximate to the inner carrier. The first liner may be attached to the inner carrier using one or more connectors coupled to the cold side of the liner, which may be actuated using at least one tool engaging the connector on a cold side surface of the liner. The connector may be actuated by accessing the inner carrier from the hot side through one or more access ports. The process may be repeated as many times as necessary.

In at least one embodiment, after nearly all of the inner liners are coupled to the inner carrier using cold side connectors, one or more liners may be coupled to the inner carrier using one or more connectors coupled to the inner carrier using connectors actuated on the hot side of the combustor. In a preferred embodiment, a single inner liner is coupled to the inner carrier using connectors actuated on the hot side of the combustor. The connectors coupled on the hot side of the liner may be actuated using one or more tools capable of engaging the connector inside the combustor cavity.

The inner liners attached to the inner carrier is this manner may be removed by first removing one or more inner liners coupled to the inner carrier using connectors actuated on the hot side of the liner. An inner liner attached to an inner carrier may be removed by loosening the connectors using a tool to engage the connector inside the combustor cavity. Once these hot side connectors have been loosened, the associated one or more inner liners may be removed. Adjacent inner liners may then be removed by loosening one or more connectors. If the adjacent inner liners are coupled to the inner carrier using one or connectors coupled to the inner carrier on the cold side of the liners, then an adjacent inner liner may be removed by first moving an access panel to open an access port. The cold side coupled connectors may then be accessed from the combustor cavity through the access port and loosened using one or more tools to engage and actuate the connector on the cold side of the annular combustor, which may also be in a chamber formed between the cold side surface of the inner liner and engine components surrounding the inner carrier. Once the connectors attaching the adjacent inner liner have been loosened, the adjacent inner liner may be removed. This process may be repeated as many times as necessary to successively remove adjacent inner liners. These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
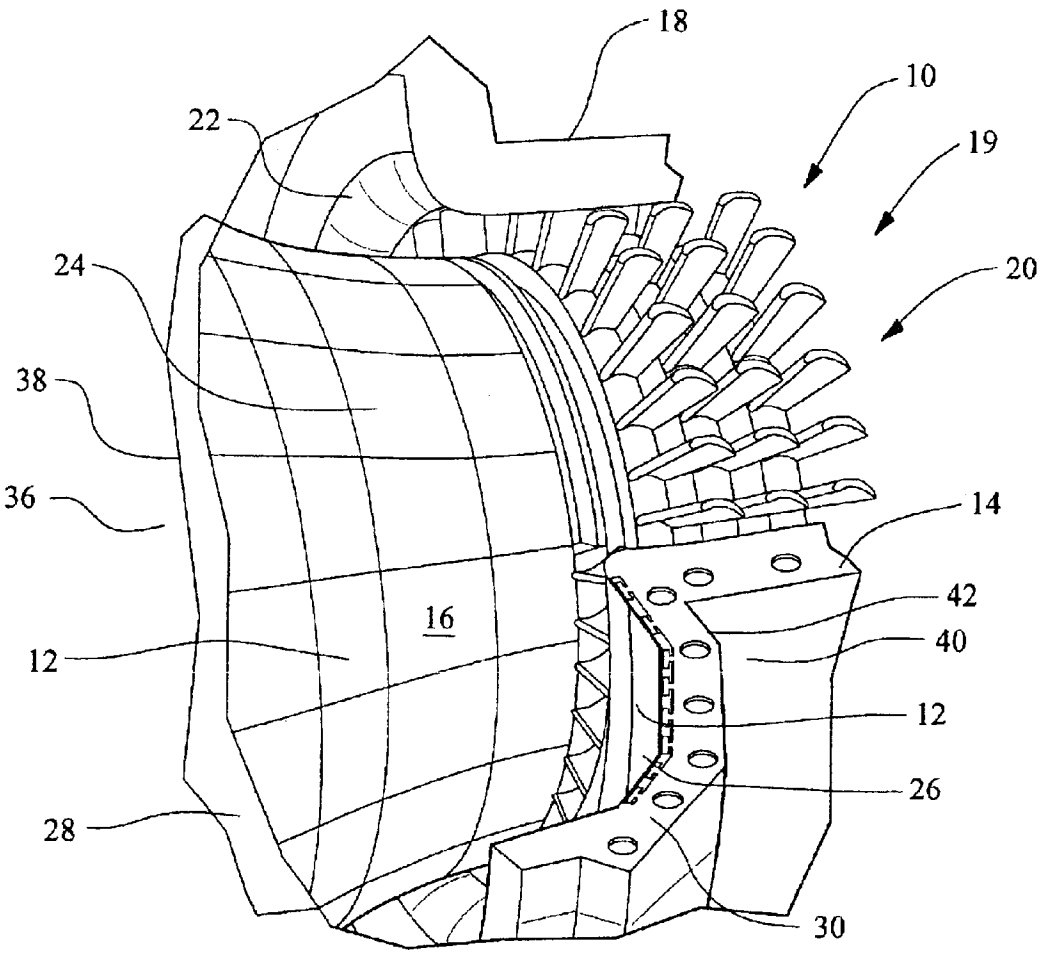
FIG. 1 is a perspective view of a combustor cavity of an annular combustor of a turbine engine having a portion of outer liners and an associated outer carrier removed.
Figure 2:
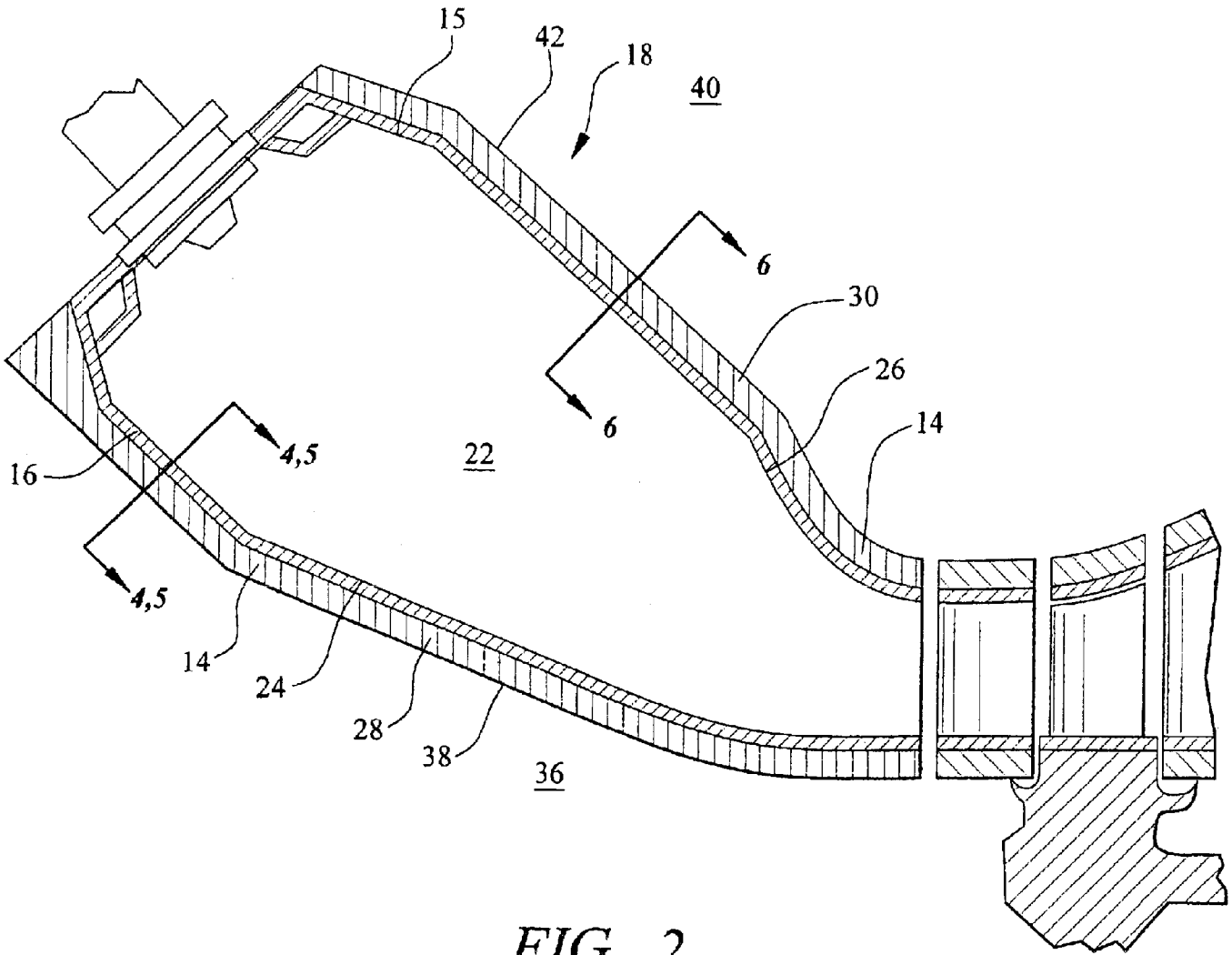
FIG. 2 is cross-sectional view of a portion of the combustion cavity of the annular combustor shown in FIG. 1.

This invention is directed to attachment system 10 for attaching liners 12 to a carrier 14 to form surfaces 16 of a combustor, such as an annular combustor 18 of a turbine engine 20, illustrated herein as an example. Turbine engine 20 may be any turbine engine having a combustor. Annular combustor 18 may be configured to receive a mixture of fuel and compressed air and to ignite the mixture. Annular combustor 18 may also be configured to pass hot combustion gases to a turbine blade assembly 19. Annular combustor 18 may be formed from a generally toroidal shaped combustor cavity 22, which may be formed from one or more inner liners 24 and one or more outer liners 26. Inner and outer liners 24 and 26 may have numerous configurations. However, in at least one embodiment, inner and outer liners 24 and 26 may be formed from a metallic or ceramic material, and each may be configured to have a generally square or rectangular outer shape.

Inner liners 24 may be coupled to an inner carrier 28, and outer liners 26 may coupled to an outer carrier 30. Outer carrier 30 may be configured to support outer liners 26 to form collectively an outer surface 15 of combustor cavity 22. Inner carrier 28 may be configured to support one or more inner liners 24 to form collectively an inner surface 16 of combustor cavity 22.

Figure 3:
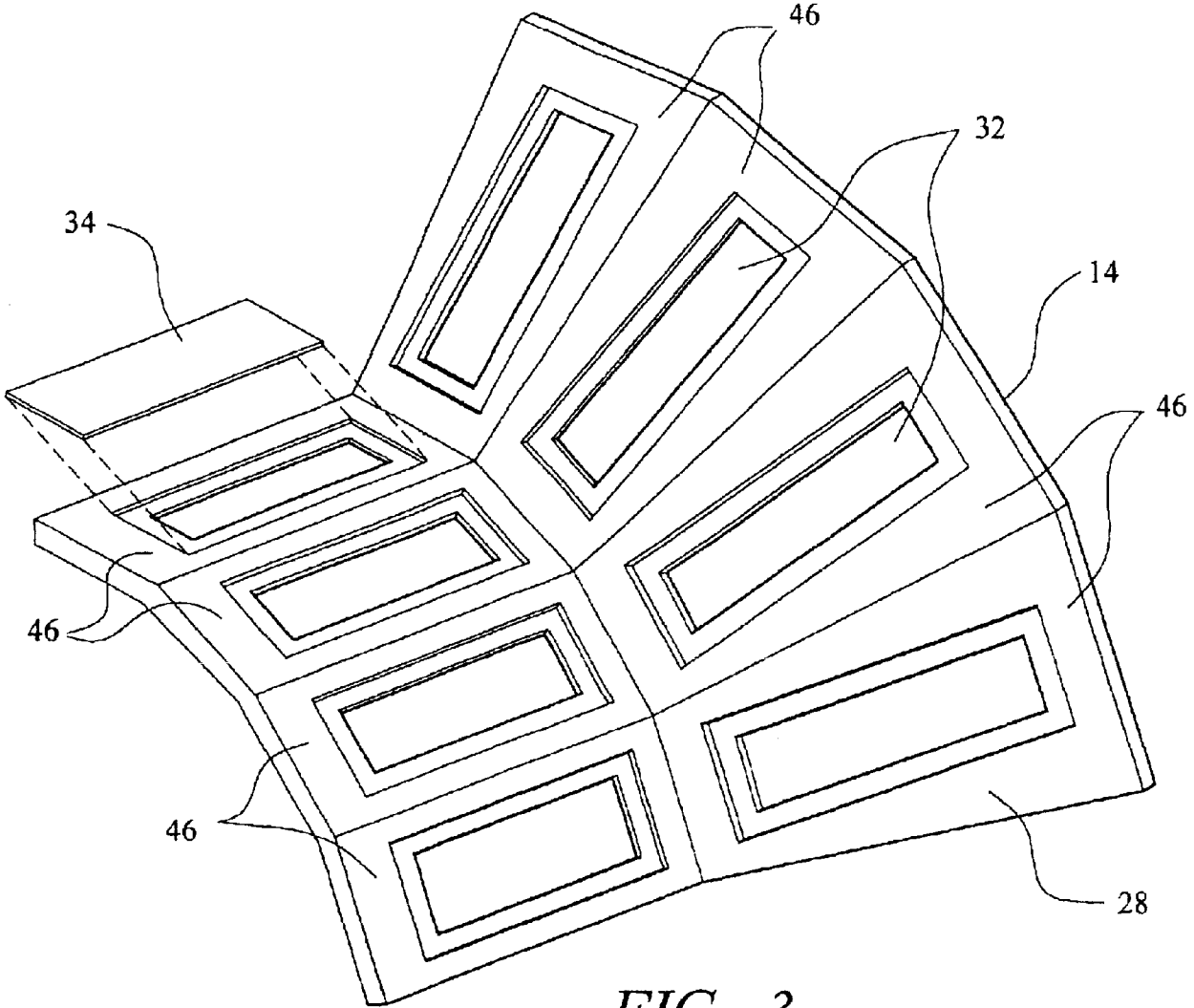
FIG. 3 is a partial perspective view of a carrier for forming a surface of the annular combustor shown in FIG. 1.

Inner carrier 28 may be formed from a generally solid structure, as shown in FIG. 3. Inner carrier 28 may include one or more access ports 32. In at least one embodiment, inner carrier 28 may include one or more access panels 34 each configured to close a respective access port 32. Access panels 34 may be releasably coupled to inner carrier 28. In at least one embodiment, access panels 34 may be positioned in inner carrier 28 so that when a single inner liner 24 is detached from the inner carrier 28, the access panel may be moved to open access port 32. Likewise, outer carrier 30 may be formed in the same configurations described for inner carrier 28 in this paragraph.

Each of inner and outer carriers 28 and 30 may have about half as many access ports 32 as the number of inner and outer liners 24 and 26 that may be coupled to the respective inner and outer carriers. For instance, inner carrier 28 or outer carrier 30, or both, each may be configured to receive 30 liners and the inner carrier may have about 15 access ports 32 that may be positioned so that every other liner receiving location 46 includes an access port 32. Each liner receiving location 46 may have any configuration capable of receiving a liner 12. In at least one embodiment, as shown in FIG. 3, liner receiving location 46 may be a substantially flat surface.

In another embodiment, inner carrier 28 or outer carrier 30, or both, may each have a plurality of access ports 32 positioned in each liner receiving location 46, except for two liner receiving locations 46 that may not include access ports 32. In yet another embodiment, inner carrier 28 or outer carrier 30, or both, may each include a plurality of access ports 32 positioned in each liner receiving location 46, except for one liner receiving location 46 that may not include access ports 32. In still another embodiment, inner carrier 28 or outer carrier 30, or both, may each include one or more of access ports 32 positioned in each liner receiving location 46. Thus, the number of access ports 32 that are positioned in inner carrier 24 or outer carrier 30, or both, may vary between a number equal to a number greater than the number of liner receiving locations 46 on the carriers and a number equal to about half of or fewer than the number of liner receiving locations 46 on the carriers. The number of access ports 32 may even be greater than four times the number of liner receiving locations 46.

Figure 4:
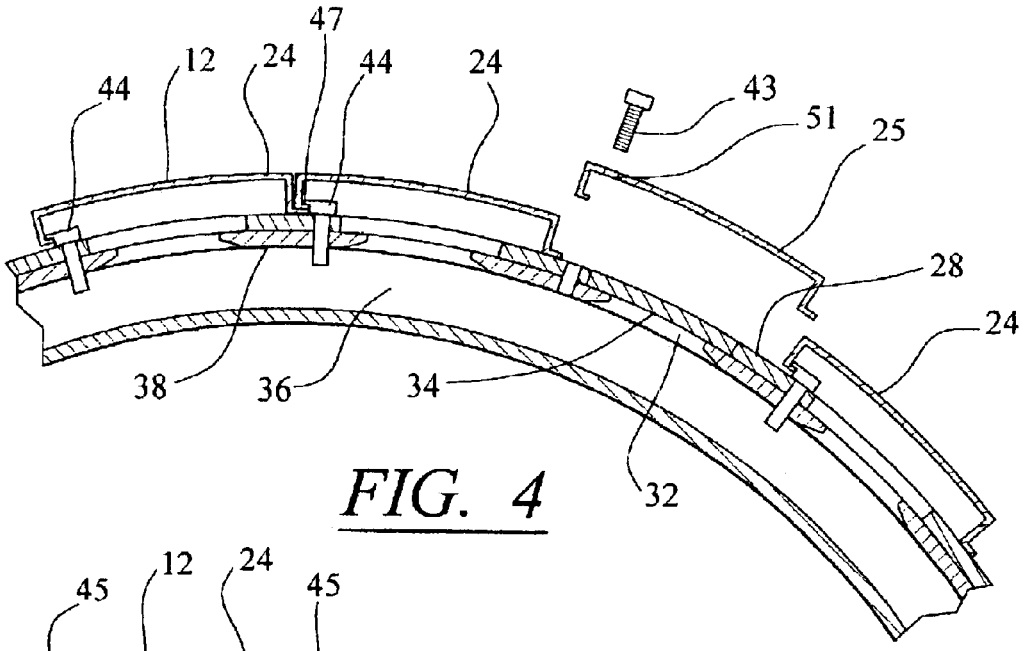
FIG. 4 is a partial cross-sectional exploded view of an inner liner taken at section line 4—4.
Figure 5:
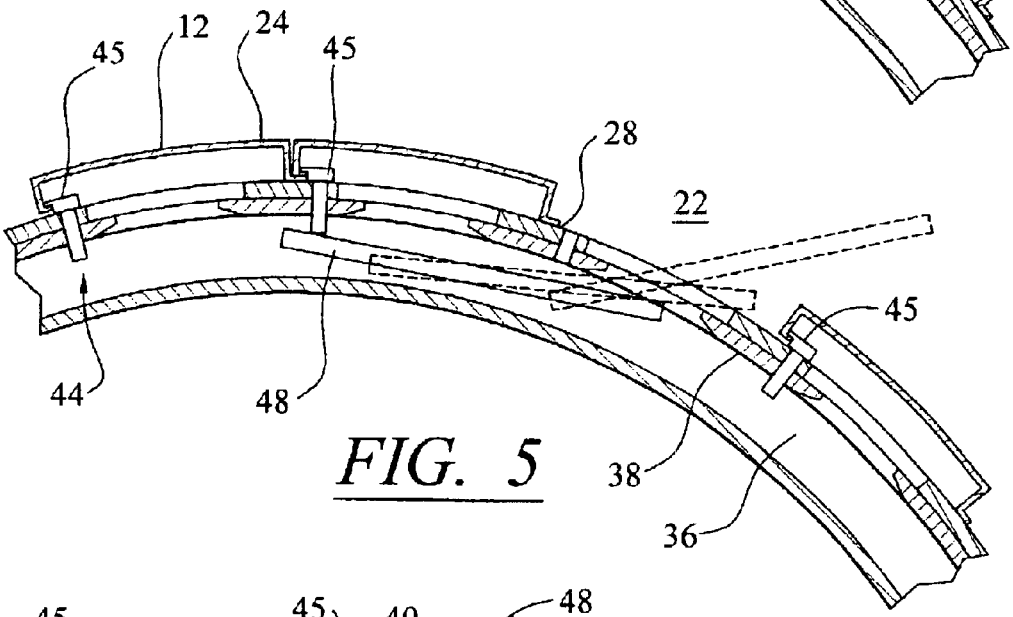
FIG. 5 is a partial cross-sectional view of the inner liner of FIG. 4.
Figure 6:
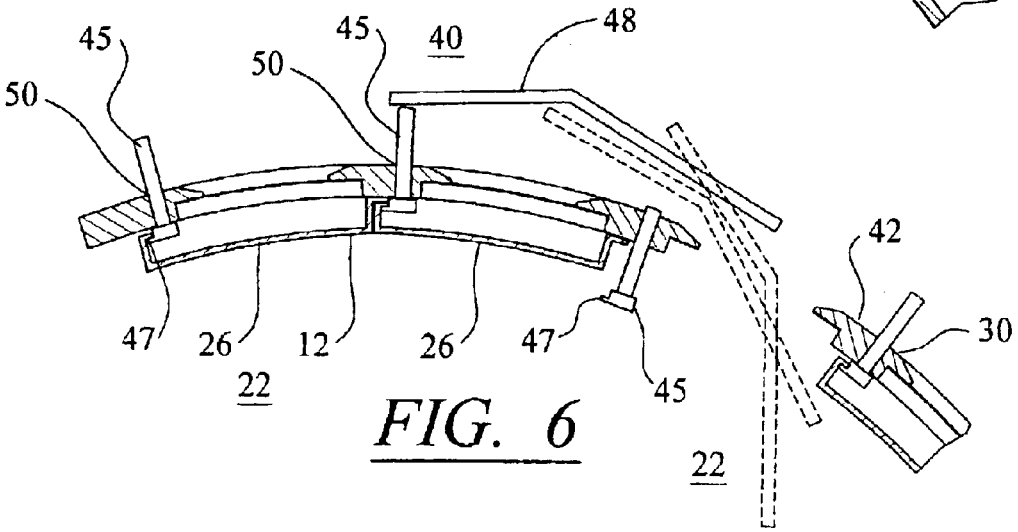
FIG. 6 is a partial cross-sectional view of an outer liner taken at section line 6—6.

Referring to FIGS. 4 and 5, inner carrier 28 may be configured so that when inner liner 24 is coupled to the inner carrier, one or more inner carrier chambers 36 may be formed between an outer surface 38 of the inner carrier 28 and internal components of turbine engine (not shown). Likewise, as shown in FIG. 6, outer carrier 30 may be configured so that when outer liner 26 is coupled to the outer carrier, one or more outer carrier chambers 40 may be formed between an outer surface 42 of the outer carrier 30 and other components of turbine engine (not shown), such as the turbine casing. Inner and outer carrier chambers 36 and 40 may be configured so that a liner may be attached to and/or removed from carrier 14 after a liner 12 and an access panel 34 have been removed to open an access port 32 through a carrier 14. In particular, inner and outer carrier chambers 36 and 40 may be configured to allow personnel; tools, such as extension arms, robotic arms, and other tools; or other items to attach a liner 12 to carrier 14 using one or more cold side connectors 44 by accessing either outer surface 38 or 42 through access port 32 from the combustor cavity 22, that is the hot side.

In at least one embodiment, inner and outer liners 24 and 26 may be attached to inner and outer carriers 28 and 30 using one or more hot side connectors 43 and cold side connectors 44. Cold side connectors 44 refers to the location of the actuation portion of the connector 44 relative to the associated liner on the cold side, that is, the side of the liner opposite the combustor cavity or other relatively high temperature environment. Similarly, hot side connector 43 refers to the position of the actuating portion of the connector 43 relative to the associated liner on the hot side, that is, the side of the liner facing the combustion cavity or otherwise exposed to a relatively high temperature environment. As used herein, a cold side coupled liner is attached to the carrier by a cold side connector 44 while a hot side coupled liner is secured to the carrier with a hot side connector 43.

Connectors 43 and 44 may be any releasable connector capable of attaching inner and outer liners 24 and 26 to inner and outer carriers 28 and 30. At least the hot side connectors 43 should be capable of withstanding the heat generated by combustion of a fuel and air mixture in combustor cavity 22. In at least one embodiment, cold side connectors 44 may be a threaded connector, such as a bolt, and a bolting rail 45 for receiving the threaded connector. Bolting rail 45 may include a lip 47 capable of being rotated to attach to a portion of a liner 24 to a carrier 28. Bolting rail 45 may be coupled to carrier 28 so that the bolting rail can move relative to the carrier 28, but not removed completely from the carrier.

For clarity and brevity, the following description describes inner carrier 28; however, this description can apply equally to outer carrier 30. In at least one embodiment, inner carrier 28 may have one or more liner receiving locations 46 and preferably may include a plurality of liner receiving locations 46. Inner liners 24 may be attached to inner carrier 28 using one or more cold side connectors 44, each capable of being actuated using at least one tool 48 engaging connector 44 outside combustor cavity 22. Actuation refers to engagement of the connector that effects its coupled and decoupling, such as torquing a bolt head on a nut or manipulating a clip release. Tool 48 may be a wrench, a socket, a pair of pliers or other device for actuating connector 44 to attach inner liner 24 to or release the inner liner from inner carrier 28. Tool 48 may also be a hand or power tool, such as, but not limited to a hydraulic or pneumatic wrenching device.

By engaging cold side connector 44 outside combustor cavity 22, tool 48 may engage connector 44 in inner carrier chamber 36 formed between outer surface 38 of inner liner 24 and engine components (not shown). In one embodiment, inner liner 24 may be preferably coupled to inner carrier 28 by inserting one or more threaded bolts 44 through orifices 50 in the inner carrier and coupling the bolts to the inner liner. Bolts 44 may be tightened against outer surface 38 of inner liner 24 to attach the inner liner to inner carrier 28.

One or more inner liners 24 may be coupled to inner carrier 28 using one or more hot side connectors 43 capable of being actuated using at least one tool 48 engaging the connector inside combustor cavity 22, which is the hot side. In at least one embodiment, an hot side coupled inner liner 25 is preferably attached to inner carrier 28 using a hot side connector 43, such as one or more threaded bolts 43 inserted through orifices 51 in the inner liner from the combustor side and coupled to the inner carrier. Bolts 44 may be tightened so that heads of the bolts bear against inner surface 16 of inner liner 24.

In at least one embodiment, a plurality of inner liners 24 may be attached to inner carrier 28 by attaching cold side connectors 44 on the cold side of annular combustor 18 and attaching a single inner liner 24 to inner carrier 28 using a hot side connector 43 coupled to the hot side of annular combustor 18. By attaching inner liners 24 to inner carrier in this manner, the number of connectors exposed to the hot side of annular combustor 18 in cavity 22 to attach inner liners 24 to inner carrier 28 is minimized. At the same time, this embodiment may also enjoy the time savings realized during repair and maintenance processes by allowing inner liners 24 to be removed from within cavity 22 in annular combustor 18. Thus, an engine casing and other related components are not required to be removed for access to the cold side connectors, as is typically the case for conventional cold bolted liner systems. Rather, cold side connectors may be accessed through an adjacent access port 32.

In particular, in at least one embodiment, a plurality of inner liners 24 may be coupled to inner carrier 28 by using cold side connectors 44 coupled on the cold side of the inner liners, thereby enabling the cold side connectors 44 to be actuated with a tool 48 engaging the cold side connectors 44 outside of combustor cavity 22. Preferably all inner liners 24, except for one inner liner, may be coupled to inner carrier 28 using one or more cold side connectors 44 by actuating the cold side connectors 44 outside of combustor cavity 22. If inner liners 24 are being installed in an existing annular turbine 18, such as during routine maintenance, the cold side connectors 44 may be tightened by accessing the connectors on an adjacent liner through an access port 32. If, however, the inner liners 24 are being installed on an inner carrier during a manufacturing process of a new annular combustor 18 of a turbine engine 20, connectors 44 may or may not be accessed through access port 32. The remaining single inner liner 24 may be coupled to inner carrier 28 using a hot side connector 43 that may be actuated by tool 48 inside combustor cavity 22 on the hot side of annular combustor 18. Thus, in this particular embodiment, only a single inner liner 24 may be coupled to inner carrier 28 with a connection exposed to the hot side of annular combustor 18.

However, this invention is not limited to this embodiment. Instead, a portion of a total number of inner liners 24 may be attached to inner carrier 28 using cold side connectors and a portion of the total number of inner liners 24 may be attached to the inner carrier using hot side connectors.

Inner liners 24 may be removed from inner carrier 28 by removing an inner liner 24 attached to the inner carrier using a hot side connector. Once at least one inner liner 24 has been removed, inner liners 24 that are coupled to an inner carrier 28 adjacent to the inner liner may be removed. If the adjacent inner liners 24 are attached to inner carrier 28 using a cold side connector, the inner liner may be removed by moving access panel 34 to open access port 32.

Once opened, one or more tools 48 may be inserted through access port 32 into inner carrier chamber 36 to release one or more cold side connectors attaching inner liner 24 to inner carrier 28. In one embodiment, a wrench 48 may be passed through access port 32 and used to loosen a plurality of cold side bolts 44 used to attach inner liner 24 to inner carrier 28. Once all of the cold side connectors have been loosened using tool 48, inner liner 24 may then be removed from inner carrier 28. This process may be repeated as many times as necessary to remove all of the inner liners 24 from inner carrier 28. The inner liners may or may not be replaced.

The foregoing is provided for purposes of illustrating, explaining, and describing embodiments of this invention. Modifications and adaptations to these embodiments will be apparent to those skilled in the art and may be made without departing form the scope or spirit of this invention.

We claim:

1. A liner assembly for a turbine combustor, comprising:

a plurality of liners arranged adjacent each other to define a hot side and an opposing cold side;

a carrier for supporting the plurality of liners, said liners being coupled to the carrier on the cold side;

at least one hot side connector for removably coupling at least one hot side coupled liner from among the plurality of liners to the carrier, said hot side connector being actuated from the hot side to couple and decouple the hot side coupled liner to and from the carrier;

at least one cold side connector for removably coupling at least one cold side coupled liner from among the plurality of liners to the carrier, said cold side connector being actuated from the cold side to couple and decouple the cold side coupled liner to and from the carrier; and said carrier having at least one access port covered by said hot side coupled liner, whereby removal of the hot side coupled liner from the carrier permits access through the at least one access port to the cold side connector to remove the cold side coupled liner.

2. The liner assembly of claim 1, wherein the at least one access port is covered by a removable access panel.

3. The liner assembly of claim 1, wherein at least one cold side coupled liner is coupled to the carrier adjacent the at least one hot side coupled liner.

4. The liner assembly of claim 1, wherein a plurality of hot side coupled liners are each coupled by at least one hot side connector to the carrier and a plurality of cold side coupled liners are each coupled by at least one cold side connector to the carrier, each of the cold side coupled liners being adjacent to a respective one of the hot side coupled liners, each of the hot side coupled liners covering a respective access port in the carrier, whereby removal of each hot side coupled liner permits access through a respective access port to a cold side connector of an adjacent cold side coupled liner.

5. The liner assembly of claim 1, wherein a plurality of cold side coupled liners are coupled in an adjacent series on the carrier, each of said cold side coupled liners being coupled by at least one cold side connector, the carrier providing a plurality of access ports, whereby removal of one of the cold side coupled liners permits access through one of the access ports to the cold side connector of an adjacent cold side coupled liner for removal of the adjacent cold side coupled liner.

6. The liner assembly of claim 1, wherein the carrier and the at least one liner forms an inner surface of an annular combustor.

7. The liner assembly of claim 6, wherein the carrier is an inner carrier of an annular combustor.

8. The liner assembly of claim 6, wherein the carrier is an outer carrier of an annular combustor.

9. A turbine combustor, comprising:

a combustor chamber formed from a plurality of liners arranged adjacent each other to define a hot side and an opposing cold side and to form an outer liner surface, and a plurality of liners arranged adjacent each other to define the hot side and an opposing cold side and to form an inner liner surface, wherein the inner liner surface is configured to fit inside a combustor cavity formed by the outer liner surface and to face the outer liner surface;

an inner carrier for supporting the plurality of liners forming the inner liner surface, said plurality of liners being coupled to the inner carrier on the cold side;

an outer carrier for supporting the plurality of liners forming the outer liner surface, said plurality of liners being coupled to the outer carrier on the cold side; and wherein at least any one of said plurality of liners, comprises:

at least one hot side connector for removably coupling at least one hot side coupled liner from among the plurality of liners to a carrier, said hot side connector being actuated from the hot side to couple and decouple the hot side coupled inner liner to and from the carrier;

at least one cold side connector for removably coupling at least one cold side coupled liner from among the plurality of liners to the carrier, said cold side connector being actuated from the cold side to couple and decouple the cold side coupled liner to and from the carrier; and said carrier having at least one access port covered by said hot side coupled liner, whereby removal of the hot side coupled liner from the carrier permits access through the access port to the cold side connector to remove the cold side coupled liner.

10. The combustor of claim 9, wherein at least one other of the plurality of liners forms the outer liner surface.

11. The combustor of claim 10, wherein the at least one of the plurality of liners forms the inner liner surface.

12. The combustor of claim 9, wherein the at least one of the plurality of liners forms the inner liner surface.

13. The combustor of claim 9, wherein a plurality of hot side coupled liners are each coupled by at least one hot side connector to the carrier and a plurality of cold side coupled liners are each coupled by at least one cold side connector to the carrier, each of the cold side coupled liners being adjacent to a respective one of the hot side coupled liners, each of the hot side coupled liners covering a respective access port in the carrier, whereby removal of each hot side coupled liner permits access through a respective access port to a cold side connector of an adjacent cold side coupled liner.

14. A method of attaching liners to a carrier to form at least a portion of a combustor of a turbine engine, comprising:

providing a carrier with at least one access port;

placing a cold side attachable liner proximate to a carrier on a hot side adjacent said at least one access port;

coupling the cold side attachable liner to the carrier using at least one connector actuated on a cold side surface of the cold side attachable liner;

coupling a hot side attachable liner to the carrier using at least one connector actuated on a hot side surface of the hot side attachable liner.

15. The method of claim 14, further comprising attaching a plurality of cold side attachable liners to the carrier using a plurality of connectors actuated on a cold side surface of each liner.

16. The method of claim 15, further comprising attaching all liners, except one hot side attachable liner, to the carrier forming at least one surface of a combustor chamber by actuating a plurality of connectors on cold side surfaces of the cold side attachable liners; and attaching the one hot side attachable liner to the carrier by actuating at least one connector on a hot side surface.

17. The method of claim 14, wherein coupling the cold side attachable liner to the carrier using at least one connector actuated on a cold side surface of the cold side attachable liner comprises accessing the at least one connector through at least one access port.

18. The method of claim 14, wherein coupling a hot side attachable liner to the carrier using at least one connector actuated on a hot side surface of the hot side attachable liner comprises accessing the at least one connector through at least one access port.

* * * * *